United States Patent [19]

Edson

[11] Patent Number: 4,697,776

[45] Date of Patent: Oct. 6, 1987

[54] SUPPORT FRAME FOR A DISPLAY CARTON

[75] Inventor: Sydney Edson, East Meadow, N.Y.

[73] Assignee: Sara Lee Corporation, Winston-Salem, N.C.

[21] Appl. No.: 850,029

[22] Filed: Apr. 10, 1986

[51] Int. Cl.[4] ..... A47F 5/08

[52] U.S. Cl. ..... 248/311.2; 211/88; 248/302

[58] Field of Search ..... 211/133, 126, 71, 88, 211/106; 248/302, 313, 311.2

[56] References Cited

U.S. PATENT DOCUMENTS

| | | | |
|---|---|---|---|
| D. 222,367 | 10/1971 | Goss | D33/3 |
| 1,621,176 | 3/1927 | Sonin | 248/313 X |
| 1,800,646 | 4/1931 | Kottke . | |
| 2,469,776 | 5/1949 | McGee | 248/302 |
| 2,470,890 | 5/1949 | Goodpasture | 248/302 |
| 2,626,119 | 6/1953 | Crosby | 248/302 |
| 2,678,184 | 5/1954 | Erdody | 248/302 |
| 3,089,597 | 5/1963 | Kaplan | 211/88 |
| 3,297,165 | 1/1967 | Radek | 211/46 |
| 3,511,461 | 5/1970 | Clark | 248/27.8 |
| 3,591,120 | 7/1971 | Fietzer | 248/302 |
| 3,830,374 | 8/1974 | Kassimir | 211/1 |
| 3,850,302 | 11/1974 | Cohen | 211/88 |
| 4,094,416 | 6/1978 | Smith | 211/71 |
| 4,151,917 | 5/1979 | Pugh | 211/216 |
| 4,324,381 | 4/1982 | Morris | 248/311.2 |

*Primary Examiner*—Richard J. Scanlan, Jr.
*Assistant Examiner*—Joseph A. Fischetti
*Attorney, Agent, or Firm*—Charles Y. Lackey; William S. Burden

[57] ABSTRACT

A skeleton-like supporting rack or frame for supporting a product display carton or the like having a substantially open front for exposing such product. The rack or frame defines a generally U-shaped section for engaging the back or rear and the sides of the carton; e. g., the bight portion engages the rear and the arms or legs of the U-shaped section engage the sides. Adjustably attached to the arms or legs of the U-shaped section are elongated brace members extending longitudinally forward of the arms or legs. These brace members terminate into generally U-shaped hook or cradle members embraceably engageable with the front edge of the side sections of the opened carton. Also, attached to the legs or arms are downwardly extending elongated L-shaped support members, the foot of the L being engageable with the bottom of the carton for supporting the same. Hooks are provided to attach the assembly to a generally vertically oriented existing support surface such as a wall.

6 Claims, 4 Drawing Figures

SUPPORT FRAME FOR A DISPLAY CARTON

BACKGROUND OF THE INVENTION

The present invention relates to racks, frames, or the like, for securely holding opened product display cartons, etc. whereby the products remain in their original cartons and are readily viewable and accessible to the customer, and can be easily attached to the carton as well as an existing structure such as a gondola or the like and occupies a minimum of space.

Some examples of the known patented prior art skeleton-type object supports are contained in the following U.S. Pat. Nos.:

| | | |
|---|---|---|
| Des. | 222,367 | 3,591,120 |
| | 1,800,646 | 4,324,381 |
| | 3,297,165 | 3,830,374 |
| | 3,511,461 | |

These patented prior art devices do not, however, disclose or suggest the present invention as will be obvious upon reviewing same.

BRIEF SUMMARY OF THE INVENTION

One of the objects of the invention is to provide an inexpensive, compact object support which can be adjusted to adapt same for supporting objects of varying sizes and configurations.

Another object of the invention is to provide a support device that can be readily attached to an existing structure and thus be placed at strategic locations.

Another object is that it can be easily manufactured from wire, albeit heavy duty type, merely by welding the various components together.

Other objects and advantages will become apparent upon reading the following detailed description and upon reference to the drawing in which.

DETAILED DESCRIPTION OF THE INVENTION

Figure 1:
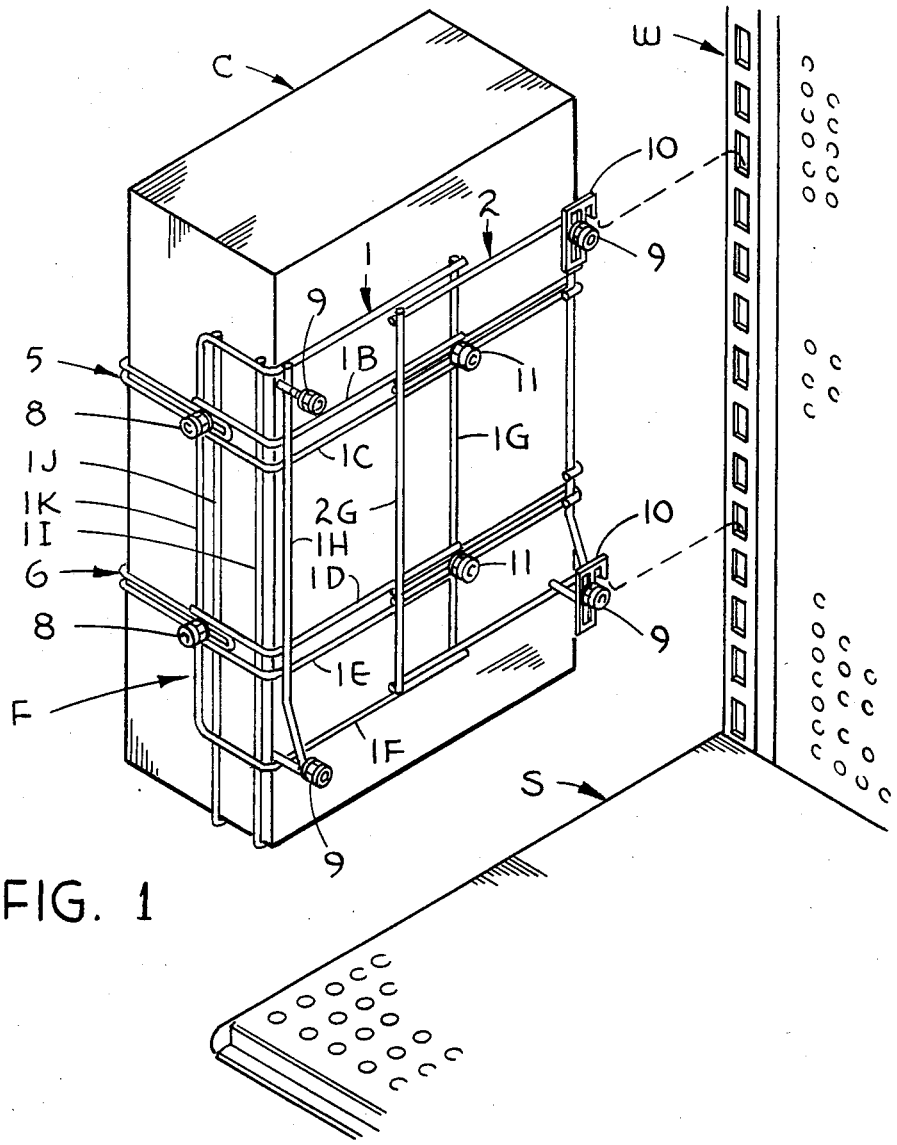
FIG. 1 is a perspective view of the support rack or frame attached to a display carton and prior to its connection to an existing support such as a gondola.
Figure 2:
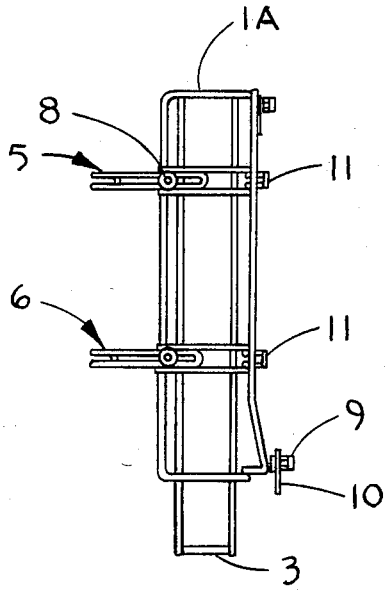
FIG. 2 is a side elevation of the support rack or frame.

While the invention is susceptible of various modifications and alternative constructions, a certain illustrated embodiment thereof has been shown in the drawings and will be described below in detail. It should be understood, however, that there is no intention to limit the invention to the specific form disclosed, but, on the contrary, the invention is to cover all modifications, alternative construction, and equivalents falling within the spirit and scope of the invention as defined in the claims.

Throughout the description, relative positional terms such as "left," "right," "above," "below," "rearwardly," "forwardly," "side," "tops" and "bottom" are used with reference to the orientation and location of the frame or rack and the carton for purposes of clarity and not in a limiting sense.

Referring first to FIG. 1, the skeleton-like supporting rack or frame generally indicated at F is attached to carton C. Adjustably mounted on frame F are vertically spaced hooks 10 adapted to be releasably attached to the vertical wall W of an existing support, such as a gondola, to attach securely said frame to said wall. A shelf S extends laterally from wall W which could, if desired, help support the bottom of frame F and carton C. However, the frame F is fully capable, which is desired, of supporting the carton C merely be being attached to the gondola wall.

Figure 3:
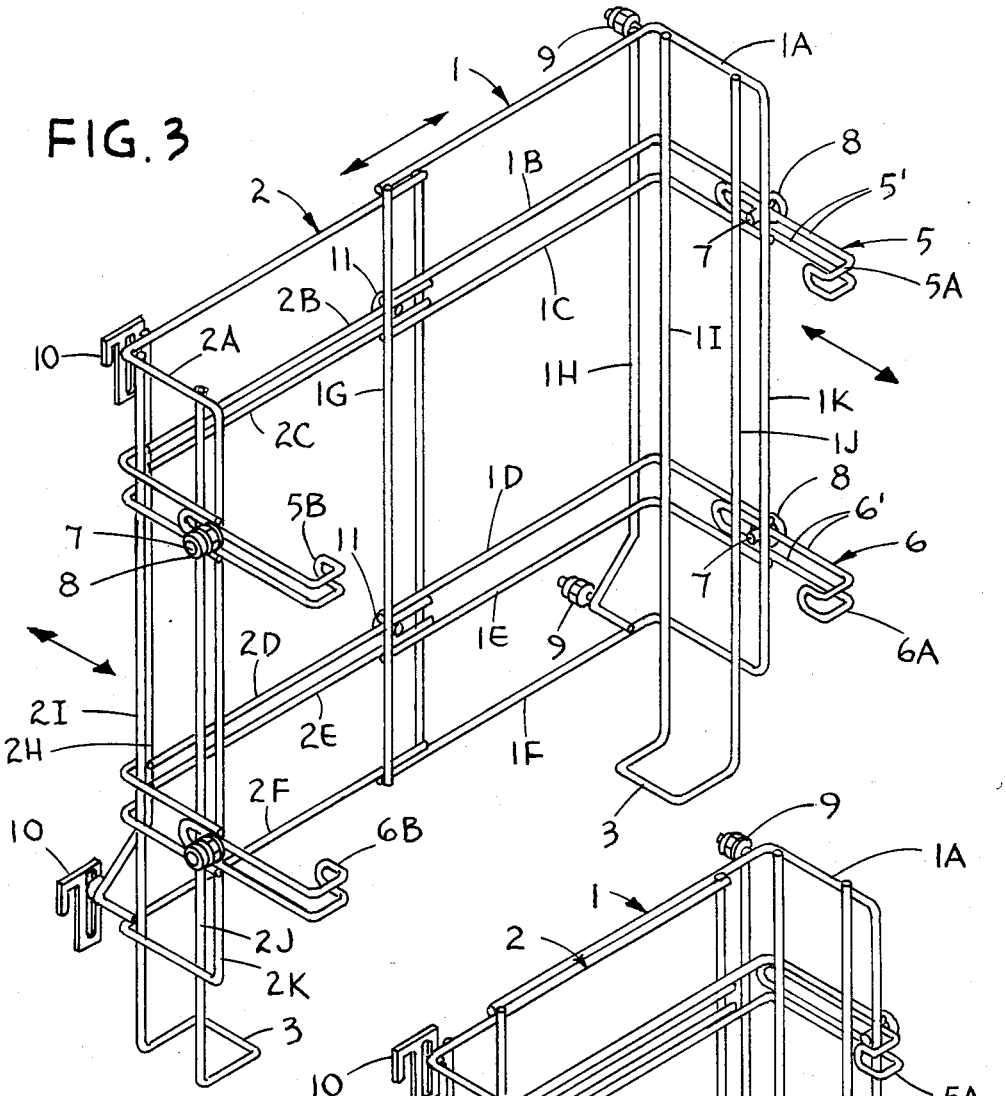
FIG. 3 is a perspective view of the support rack or frame in substantially maximum adjusted position.
Figure 4:
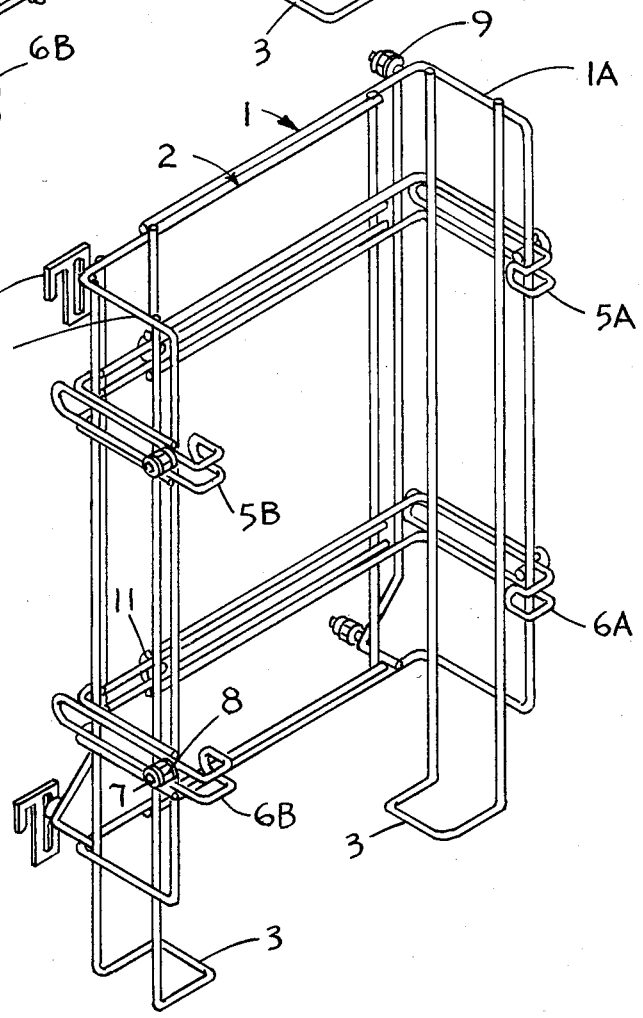
FIG. 4 is a perspective view of the same in substantially minimum adjusted position.

Referring now to FIGS. 3 and 4 which most clearly illustrate the specific details of frame F which is formed of two substantially similar units 1 and 2 slidably connected to afford relative lateral adjustment, each being formed of heavy stiff wire or small elongated rods.

The units each comprise vertically spaced horizontally disposed L-shaped members 1B–1F, 2A–2F interconnected by vertically extending members 1G–1K, 2G–2K, as, for example, by welding. Since the units are substantially similar, only one will be further specifically described. As shown, bottom and top members 1A and 1F are integral with vertical member 1K. However, member 1K could be welded or otherwise attached to members 1A and 1F. As shown in FIGS. 3 and 4, vertical members 1I and 1J at the lower ends thereof are bent or otherwise fashioned to terminate into a horizontal extending shelf or carton support structure 3. Attached to the foot of the L are horizontally spaced adjustable carton engaging members 5 and 6. Members 5 and 6 terminate into U-shaped cradle-like ends 5A and 5B engageable with the front edge of the side of a carton to hold same captive when adjusted and fixed in position. Members 5 and 6 are comprised of spaced members 5' and 6' which are slidably received between members 1B and 1C, 1D and 1E respectively. Attached, as by welding, to vertical member 1K are spaced threaded bolts 7 extending between members 5' and 6', the arrangement being such that said members are freely slidable relative to members 1B and 1C, 1D and 1E and bolts 7. Cap nuts 8 are threaded to bolts 7 whereby when members 5 and 6 are adjusted to their desired position said nuts are tightened to lock or clamp the display carton firmly into position.

Attached to the rear corners of the units 1, 2 are bolt-cap nut clamp-lock arrangements 9 of the type previously described with respect to adjustable carton engaging members 5 and 6, which are adapted to secure adjustably gondola or other support hooks 10 in position whereby either side of the unit can be attached to such support.

The legs of the L-shaped member 1 and 2 are also provided with bolt-cap nut locking arrangements 11 to secure them adjustable in desired adjusted position for engaging backs of cartons of various widths. Vertically spaced bolts 7 are secured to member 1G and cap nuts 8 clamp members 2B, 2C and 2D, 2E to member 1G.

Preliminary to fastening the frame and display carton to the wall of a gondola or similar structure, units 1 and 2 are adjusted and secured in position to receive snugly and embrace the rear and sides of the display carton with the bottom of the carton resting on support structures 3, 3. Note that U-shaped cradle ends 5A, 6A, and 5B, 6B embrace the forwardly facing vertically extending edges of the sides of the carton. Once the above-noted adjustments are properly made, the frame and with it the display carton are ready to be attached to the wall of the gondola or like structure by adjustable hooks 10 with the products viewable and accessible through the opened front thereof.

From the foregoing description, it will be apparent that various changes may be made without departing from the spirit and scope of the invention as defined by the following claims.

What is claimed is:

1. A support frame for holding a generally rectangular display carton having an open front, encompassed by side, top, bottom, and rear walls comprising: a generally U-shaped skeleton-like structure defined by a vertically extending rear section engageable with the rear wall of the carton; said U-shaped structure further defined by vertically extending opposed end sections integral with and extending in a direction transverse to said rear section engageable with the side walls of the carton; horizontally extending carton support means integral with said end sections and extending transversely thereof and facing each other for engagement with the bottom of the carton; confining means on said end sections extending in a generally coplanar manner therewith having means engageable with front edges of the side walls of the carton to confine the carton in said support frame, said rear section being divided into plural slidably interconnected laterally adjustable members for receiving cartons of varying sizes and including means to lock the last mentioned members in selected adjusted position.

2. The structure as defined in claim 1 wherein said confining means are adjustably attached to said end sections for engaging cartons of varying sizes.

3. The structure as defined in claim 1 wherein said confining means terminates into a hook-like end for embracing the edges of the carton side walls.

4. The structure as defined in claim 1 wherein the support frame is a skeleton-like structure fabricated from individual heavy-duty wire or generally light rod-like members which are spaced from and attached to each other forming said skeleton-like structure.

5. The structure as defined in claim 1, further comprising means on said frame attaching the same to an existing structure.

6. The structure as defined in claim 5 wherein said last-mentioned means are adjustably mounted on said frame.

* * * * *